US006173666B1

(12) United States Patent
Morrison

(10) Patent No.: US 6,173,666 B1
(45) Date of Patent: Jan. 16, 2001

(54) DEVICE FOR RECEIVING NEEDLEPOINT EMBROIDERY MATERIAL

(76) Inventor: J. Richard Morrison, 52 Railroad Pl., Hopewell, NJ (US) 08525

( * ) Notice: Under 35 U.S.C. 154(b), the term of this patent shall be extended for 0 days.

(21) Appl. No.: 09/473,756

(22) Filed: Dec. 28, 1999

(51) Int. Cl.[7] ..... D05C 17/02
(52) U.S. Cl. ..... 112/439
(58) Field of Search ..... 112/439, 475.18, 112/475.22, 104, 7, 98–101, 413; 156/93; 428/4, 102, 113, 230, 234, 246, 906.6, 913.3

(56) References Cited

U.S. PATENT DOCUMENTS 1,409,214 * 3/1922 Einstein ..... 112/439 X
3,010,180 * 11/1961 Hoffman ..... 112/439
3,075,865 * 1/1963 Cochran ..... 112/439
3,240,176 * 3/1966 Morrison ..... 112/439 X
3,570,435 * 3/1971 Morrison ..... 112/439 X
4,404,750 * 9/1983 Marx et al. ..... 112/439 X

* cited by examiner

*Primary Examiner*—Ismael Izaguirre
(74) *Attorney, Agent, or Firm*—McCormick, Paulding & Huber LLP

(57) ABSTRACT

A device for receiving needlepoint embroidery includes a base, which includes a first layer of an elastic material, and a second layer of an elastic material underlying and coupled to the first layer. The second layer is thicker than the first layer to support the first layer and the second layer. A plurality of wedge type slots is defined by the first layer and the second layer for receiving the embroidery material. The slots are disposed in approximately parallel rows with adjacent rows of the slots staggered and overlapping with respect to each other. The device also includes a third layer of penetrable yieldable cellular material underlying and coupled to the second layer, and a fourth layer of substantially rigid material underlying and coupled to the third layer for supporting and protecting the third layer. A way for identifying the locations of the slots is provided.

7 Claims, 4 Drawing Sheets

DEVICE FOR RECEIVING NEEDLEPOINT EMBROIDERY MATERIAL

FIELD OF THE INVENTION

The present invention relates generally to an apparatus for ornamentation, and deals more particularly with a device for receiving needlepoint embroidery material.

BACKGROUND OF THE INVENTION

The art of needlepoint embroidery requires skill, practice and a large amount of time. A method for simulating needlepoint embroidery which does not require special skill in needlepoint art and is intended for use by anyone is described in U.S. Pat. No. 3,240,176 titled Method for "Making Simulated Needlepoint Embroidery", which was issued to the present Applicant, and is hereby incorporated by reference. As shown in FIGS. 1–3, the '176 patent employs a kit 10 which includes a base 12 with slits 14 for inserting pieces of strands of compressible embroidery yarn 16, such as wool, with a specially designed insertion tool 18. The yarn 16 extends between the slits 14 and creates the appearance of needlepoint embroidery.

Years of experience have shown a number of drawbacks to the kit described in the '176 patent. For instance, the surface of the base is subject to buckling while the yarn is being inserted, since the surface layer is no more than 0.002 inch thick. In addition, the slits are too narrow to hold material with a larger or less compressible cross-section than the yarn without tearing the surface. The slits can be very difficult to see and locate, especially in darker sections of the surface, since the slits are very narrow and formed only in the thin surface of the base.

Another drawback is that gaps exist between the rows of yarn after the yarn has been inserted into the slits, which displays the underlying unattractive surface of the base. The inserted yarn also does not completely cover the edges of the work area, again displaying the underlying unattractive surface. In addition, the insertion tool unintentionally pierces the surface and causes scratches and tears in the surface.

It is an object of the present invention to overcome the drawbacks of the prior art.

It is also an object of the present invention to be able to produce additional needlepoint embroidery effects.

SUMMARY OF THE INVENTION

A device for receiving needlepoint embroidery includes a base, which includes a first layer of an elastic material, and a second layer of an elastic material underlying and coupled to the first layer. The second layer is thicker than the first layer to support the first layer and the second layer. A plurality of wedge type slots is defined by the first layer and the second layer for receiving the embroidery material. The slots are disposed in approximately parallel rows with adjacent rows of the slots staggered and overlapping with respect to each other. The device also includes a third layer of penetrable yieldable cellular material underlying and coupled to the second layer, and a fourth layer of substantially rigid material underlying and coupled to the third layer for supporting and protecting the third layer. A means for identifying the locations of the slots is provided.

DETAILED DESCRIPTION OF THE PREFERRED EMBODIMENT

Figure 1:
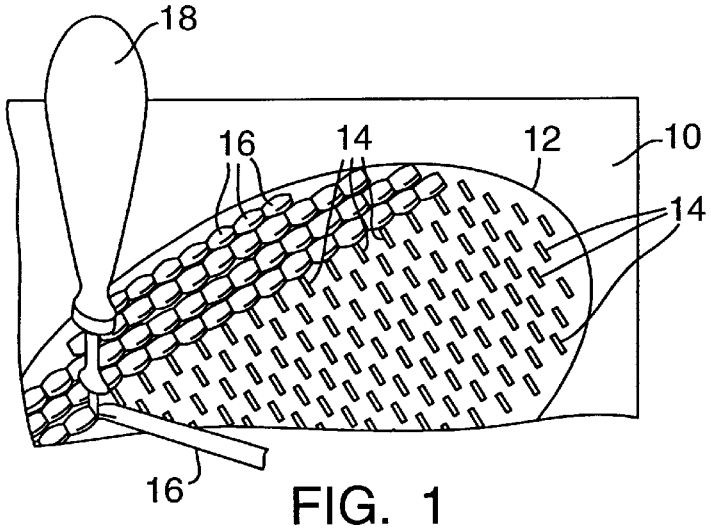
FIG. 1 PRIOR ART
FIG. 1 is a diagrammatic plan view of the '176 kit showing an illustrative area of a base in the process of receiving embroidery yarn.
Figure 2:
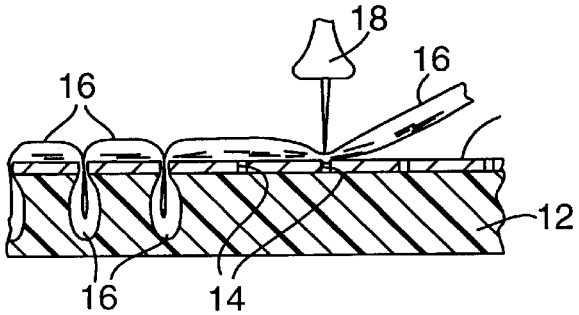
FIG. 2 PRIOR ART
FIG. 2 is an enlarged fragmentary cross-section view of FIG. 1.
Figure 3:
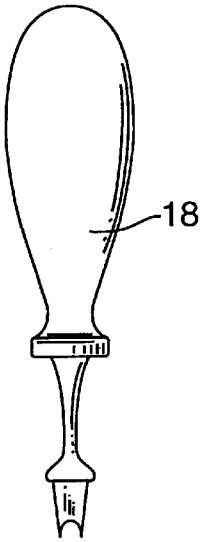
FIG. 3 PRIOR ART
FIG. 3 is a front view of one form of tool of FIG. 1.
Figure 4:
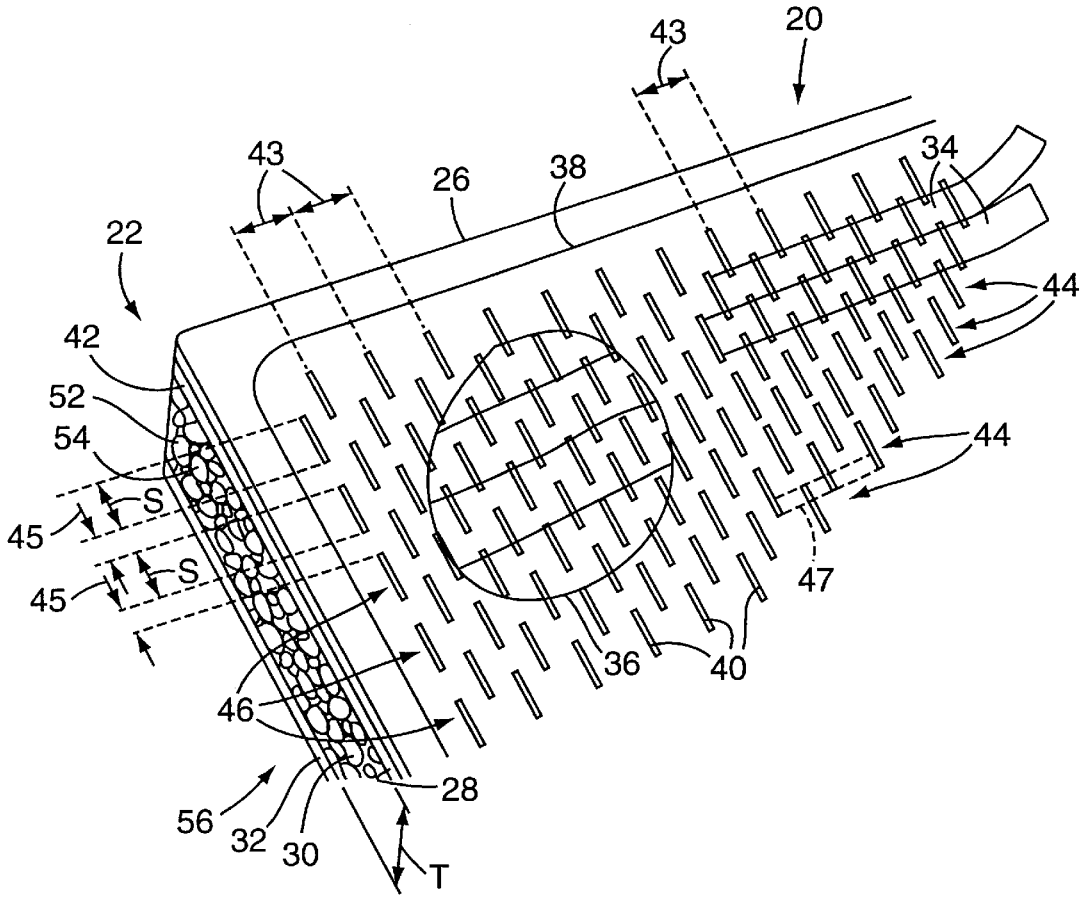
FIG. 4 is diagrammatic plan view of a base embodying the present invention.

In the embodiment of the present invention as shown in FIG. 4 and FIG. 7, a device 20 for receiving needlepoint embroidery material includes a base 22 and a tucking tool 24. As shown in FIG. 4, the base 22 is composed of a first layer 26, a second layer 28, a third layer 30 and a fourth layer 32 adhesively bonded together. The first layer 26, or surface layer 26, is thin and made of an elastic material, preferably a hard parchment type paper with a dull gloss, such as a 65 # cover stock. The "elasticity" of the material alludes to an inherent stiffness and to the tendency of the walls of a hole or aperture to resist enlargement of the hole and thus exert a pinching effect upon a compressible material extending through the hole and having a normal cross-sectional area greater than that of the hole.

Referring to FIG. 4, the surface layer 26 is preferably ornamented with a colored picture or design as a guide for determining the color of embroidery material 34 to be inserted, such as yarn. A colored picture 36 or design 38 imprinted on the surface layer 26 also ensures a solid color effect between any gaps in the inserted material 34 and around the edges of the picture where material is not inserted and the surface layer is visible. Although a colored picture or design has been described, the present invention is not limited in this regard as a plain surface layer of any color, such as white, may be used without departing from the broader aspects of the present invention.

Continuing with FIG. 4, the second layer 28, which is made of an elastic material, underlies and adhesively couples to the first layer 26. The second layer 28 is thicker than the first layer 26 in order to support the first layer 26 and prevent them from being ruptured or torn under mildly applied pressure used to insert the material 34 with the tucking tool 24 through a slot 40 in the first and second layers. The material 34 to be inserted, such as yarn, is selected to have a cross-sectional area greater than the slot 40. Preferably, the second layer 28 is a solid white soft type blotter board 42, with a 30 thickness of approximately 0.04 to 0.06 inches. The thick soft, board 42 opens easily and offers little resistance when the material 34 is inserted through the slot 40 in the board with the tucking tool 24, but the board's elasticity provides a pinching effect to hold the material in place. The thickness of the board 42, along with the design of the tucking tool 24, helps prevent accidental damage to the appearance of the picture 36 or the design 38 caused by inserting the tucking tool through an area of the board which does not have the predefined slots 40.

As shown in FIG. 4, a plurality of the preformed, wide, deep, wedge shaped slots 40 are jointly defined in the first layer 26 and second layer 28 of the base 22. The slots 40 are arranged in rows 44, lie crosswise with respect to the row, and are preferably uniformly spaced apart. Preferably, the slots 40 in each row 44 are about 0.014 inches apart 43, with each slot being about 9/64 inches in length S. The rows 44 are approximately parallel to each other, with adjacent rows staggered and overlapping. Preferably, alternating rows 46 of slots are 7/64 inches apart 45, and the slots 40 of adjacent rows 44 overlap by 1/32 inches 47. The overlap 47 of adjacent rows 44 allows substantially complete coverage of the surface layer 26 between the rows by the material 34 after insertion of the material 34.

Figure 5:
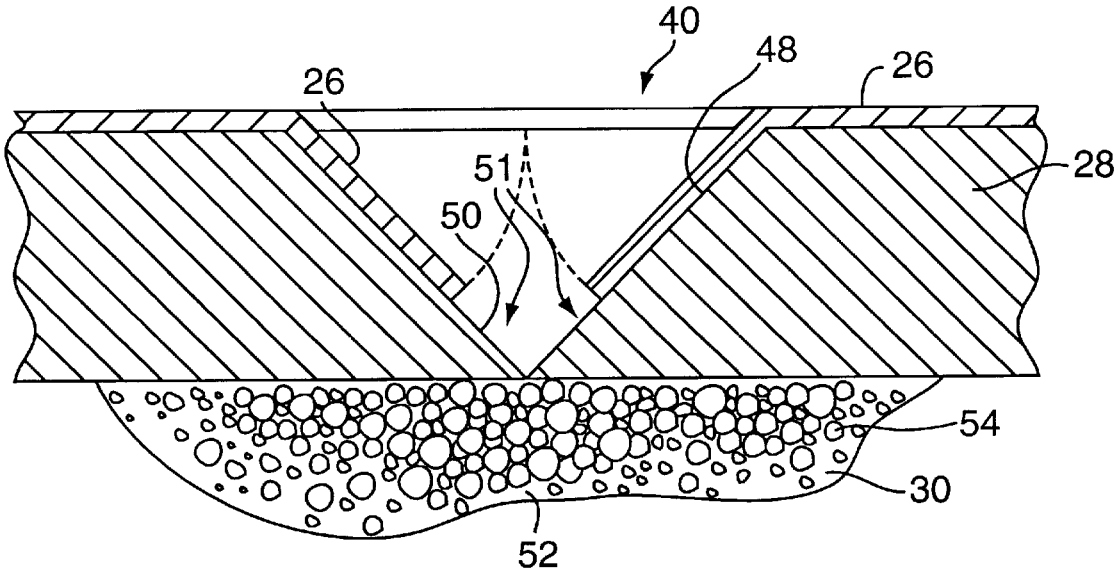
FIG. 5 is a enlarged fragmentary cross-section view of the base and a slot of FIG. 4.

Referring to FIG. 5, the wide wedge type slot 40 allows sufficient space to accommodate bulky materials 34, such as yarn and ribbon, without ripping or tearing the surface layer 26 and the second layer 28. While yarn and ribbon have been shown as materials to be inserted, the present invention is not limited in this regard as other materials, such as braids and velvet, may be used without departing from the broader aspects of the present invention.

Continuing with FIG. 5, the wide, deep, wedge type slot 40 is die cut to completely penetrate the surface 26 and second 28 layers to ensure easy insertion of the material 34 through these layers. The thickness of the second layer 28 maintains the wide, wedge type form of the slot 40 after the slot is cut. The wide, deep, wedge type slot 40 provides means for easily identifying and locating the slot on the surface layer 26. The die cutting of the slot 40 pushes the first layer 26 down into the slot, covering approximately 50% of the internal surface 48 of the slot. The uncovered remainder 50 of the surface 48 of the deep, wedge shaped slot 40 shows the underlying white second layer 28, producing a light effect which makes the location of the slot easily visible even in black or dark areas of the surface layer 26. The wide, deep slot 40 also produces a pronounced shadow effect, making the location of the slot easily visible in white or light areas of the surface layer 26. The shape of the wide, deep, wedge type slot 40 also makes the slot easy to locate by touch with the tucking tool 24.

Continuing with FIGS. 4 and 5, the third layer 30 underlies and is adhesively coupled to the second layer 28. The third layer 30 has a surface firmness and overall rigidity to support itself under the stress of the tucking tool 24. The third layer 30 is made of a penetrable yieldable cellular construction 52, preferably 2 pound (EPS) micro-bead foam 54 with good memory characteristics, and is 1/4 to 3/8 inches thick T. The term "cellular" is intended to signify the presence of a multiplicity of air- or gas-filled spaces which are readily collapsible under mildly applied relatively concentrated pressures. The third layer 30 is yieldable and readily penetrable during insertion of the material 34 under the pressure of the tucking tool 24. Use of the foam 54 with good memory characteristics helps maintain the original thickness of the base 22 when the outside perimeter 56 of the base is die cut. The micro-bead foam 54 also die cuts cleanly and smoothly.

As shown in FIG. 4, the fourth layer 32 underlies and is adhesively coupled to the third layer 30 to add rigidity to the base 22, and to maintain and protect a flat bottom surface of the third layer. Preferably, the fourth layer 32 is a chipboard ranging from 0.03 to 0.04 inches thick.

Figure 6:
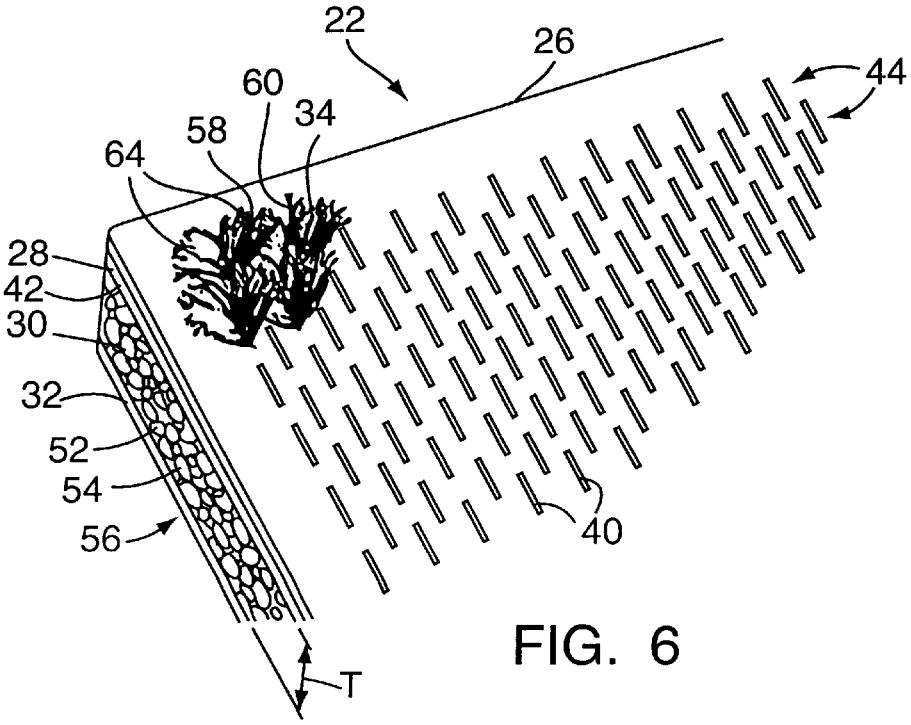
FIG. 6 is a diagrammatic plan view of the base of FIG. 4 showing a latch hook effect after insertion of material.

As shown in FIG. 6, the thick second layer 28 and deep, wide, wedge type slots 40 permit new needlepoint embroidery effects 58. Each slot 40 can securely hold a piece of material 34 by itself, which allows creation of a latch hook effect 60. The latch hook effect 60 is created by inserting into a single slot 40 the center of a section of material 34, such as yarn, causing the ends 64 of the material to protrude from the surface layer 26. The material 34 to be inserted should be long enough, preferably about 1 inch long, so that the protruding ends 64 of the material cover the surface layer 26. The ends 64 of the material 34 may be trimmed to a preferred height, as long as the material continues to cover the surface layer 26.

Figure 7A:
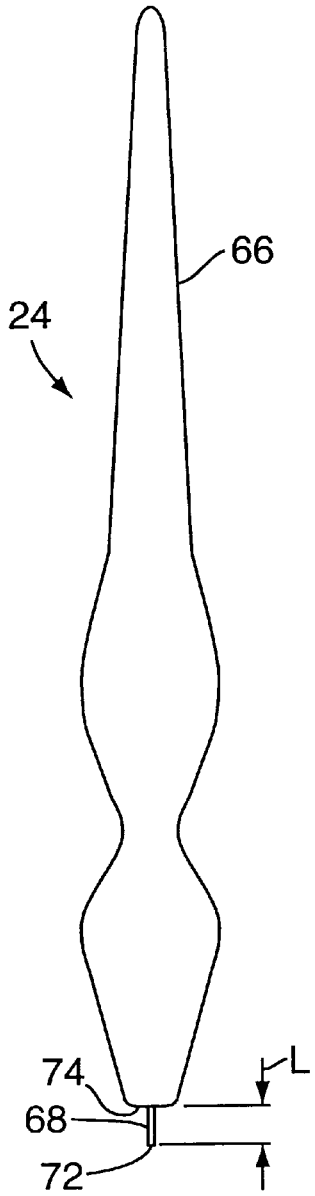
FIG. 7A is a front view of an embodiment of a tucking tool for use with the base of FIG. 4.
Figure 7B:
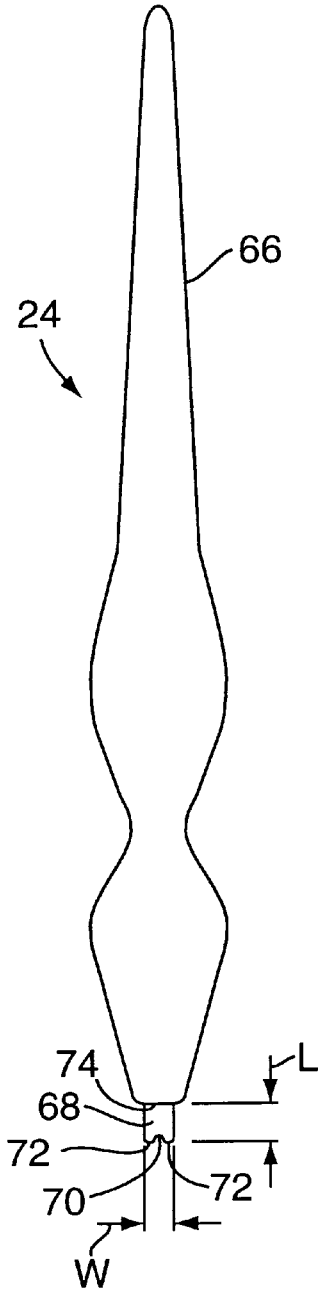
FIG. 7B is a side view of the tucking tool of FIG. 7A.

FIGS. 7A and 7B show an embodiment of the tucking tool 24 which is designed to insert and remove material 34 from the base 22. The tucking tool 24 includes a handle 66 and a tool tip 68. The tool tip 68 is a flat spatulate operative end having a front edge 70 which is preferably concave and is preferably made of metal. The concavity terminates in rounded points 72 to reduce scratching of the surface layer 26 and prevent deliberate or accidental penetration of the surface 26 and second 28 layers. The rounded points 72 of the tool tip 68 are also safety features for operators of the tucking tool 24. The tool tip 68 is metal plated for easy insertion and withdrawal from the slot 40, and the concavity of the front edge 70 conforms to material 34 which has a round shape, such as yarn, for better control during insertion.

Continuing with FIGS. 7A and B, the tucking tool 24 has a forward facing shoulder 74 from which the tool tip 68 protrudes. The length L of the tool tip 68 extending from the shoulder 74 to the front edge 70 of the tool tip is a predetermined distance, preferably 3/16 inches, to conservatively control the amount of material 34 inserted into each slot 40 and prevent waste of the material. The width W of the tool tip 68 is slightly smaller than the width S of each slot 40 to allow extra space when inserting bulky material 34 into the slots.

In operation, successive spaced loops of a strand of the compressible material 34, such as yarn, are pushed into the base 22 through the slots 40 in the base with the tucking tool 24. Each of the loops of material 34 are entirely accommodated within the interior of the base 22 by the collapse of the cells of the foam 54 making up the third layer 30. The interior walls 51 of each of the slots 40 in the first layer 26 and the second layer 28 frictionally snare and pinch the neck of each loop of material 34. The section of the material 34 between the snared loops lies in uncompressed, untensioned, exposed condition on the ornamented surface layer 26 of the base 22, providing a striking resemblance to conventional tapestry embroidery. The overlapping 47 adjacent rows 44 of slots 40 ensure that the material 34 completely covers the ornamented surface layer 26.

In general it will be understood that many of the details herein described and illustrated may be modified by those skilled in the art without necessarily departing from the spirit and scope of the invention as expressed in the appended claims.

What is claimed is:

1. A device for receiving needlepoint embroidery material, comprising a base, wherein said base includes:

a first layer of an elastic material, a second layer of an elastic material underlying and coupled to said first layer, said second layer having a thickness greater than said first layer, a plurality of wedge type slots defined by said first layer and said second layer for receiving said embroidery material, said slots disposed in substantially parallel rows wherein adjacent rows are staggered and overlapping with respect to each other, a third layer of penetrable yieldable cellular material underlying and coupled to said second layer, a fourth layer of substantially rigid material underlying and coupled to said third layer for supporting and protecting said third layer, and identifying means for locating said slots.

2. A device for receiving needlepoint embroidery material as defined in claim 1, wherein said identifying means includes:

said wedge type slot having a shadow effect for locating said slot in said first layer, wherein said first layer is light colored or white; and said wedge type slot having a light effect for locating said slot in said first layer, wherein said first layer is dark colored or black.

3. A device for receiving needlepoint embroidery material as defined in claim 2, wherein said shadow effect is caused by width of said slot and depth of said slot.

4. A device for receiving needlepoint embroidery material as defined in claim 2, wherein said light effect includes exposure of said second layer within said slot, wherein said second layer is light colored or white.

5. A device for receiving needlepoint embroidery material as defined in claim 1, wherein said identifying means includes said wedge type slot being wide and deep for locating said slot by touch.

6. A device for receiving needlepoint embroidery material as defined in claim 1, further comprising:

a tucking tool for inserting the embroidery material in said base, wherein said tucking tool includes a handle, and a tool tip protruding from said handle, said tool tip having a front edge terminating in rounded points for preventing deliberate and accidental penetration of said base.

7. A device for receiving needlepoint embroidery material as defined in claim 1, wherein each of said wedge type slots has a wide and deep shape for securely holding a piece of embroidery material, wherein each piece of said embroidery material is inserted in a single slot for creating a latch hook effect.

* * * * *